US007363685B2

(12) United States Patent
Walker et al.

(10) Patent No.: US 7,363,685 B2
(45) Date of Patent: Apr. 29, 2008

(54) HANDLE ASSEMBLY FOR TOOL

(75) Inventors: Andrew Walker, Newton Hall (GB); Brian Wadge, Coxhoe (GB); Tim McKay, Fair Meadows (GB); Nigel Robson, Lowfell Gateshead (GB); Ian Sokell, Spennymoor (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/602,108

(22) Filed: Jun. 23, 2003

(65) Prior Publication Data

US 2004/0078936 A1 Apr. 29, 2004

(51) Int. Cl.
*B25G 3/00* (2006.01)

(52) U.S. Cl. ..... 16/430; 16/431; 16/421; 16/110.1; 173/170; 173/162.1; 408/124; 408/241 R

(58) Field of Classification Search ..... 16/110.1, 16/111.1, 421, 430, 431; 451/524; 173/170, 173/162.1; 408/124, 241 R
See application file for complete search history.

(56) References Cited

U.S. PATENT DOCUMENTS

| | | | | |
|---|---|---|---|---|
| 0,588,794 | A | | 8/1897 | Granger |
| 0,593,162 | A | | 11/1897 | Miller |
| 3,713,350 | A | | 1/1973 | Brilando |
| 4,416,166 | A | | 11/1983 | Jannard et al. |
| 4,667,749 | A | | 5/1987 | Keller |
| 4,721,021 | A | | 1/1988 | Kusznir |
| 4,739,536 | A | | 4/1988 | Bandera et al. |
| 4,974,286 | A | | 12/1990 | Stowell et al. |
| 5,088,734 | A | | 2/1992 | Glava |
| 5,267,487 | A | | 12/1993 | Falco et al. |
| 5,280,735 | A | | 1/1994 | Kuipers et al. |
| 5,298,821 | A | * | 3/1994 | Michel ..... 310/47 |
| 5,353,474 | A | * | 10/1994 | Good et al. ..... 16/421 |
| 5,355,552 | A | * | 10/1994 | Huang ..... 16/421 |
| 5,860,183 | A | * | 1/1999 | Kam ..... 15/167.1 |
| 5,893,297 | A | | 4/1999 | Rowe |
| 5,926,911 | A | | 7/1999 | Chen |
| 6,058,815 | A | * | 5/2000 | Habermehl ..... 81/434 |
| 6,101,628 | A | | 8/2000 | Earl |
| 6,106,870 | A | | 8/2000 | Lo |
| 6,128,808 | A | | 10/2000 | Jansson et al. |

(Continued)

FOREIGN PATENT DOCUMENTS

| | | |
|---|---|---|
| DE | 709757 | 8/1941 |

(Continued)

*Primary Examiner*—Katherine Mitchell
*Assistant Examiner*—Marcus Menezes
(74) *Attorney, Agent, or Firm*—Harness, Dickey & Pierce, P.L.C.

(57) ABSTRACT

A handle assembly for a power tool 1 comprises a housing 2 defining a handle 4 and housing a motor for actuating an output member of the tool, such as a drill bit or jigsaw blade. The handle assembly comprises at least one flexible sheet 8 adapted to be mounted to a surface of the handle of the power tool and having a series of protrusions 10 adapted to be engaged by a hand of a user of the tool. The protrusions 10 retain one or more blister packs (not shown) containing at least one vibration damping gel material between the flexible sheet 8 and the surface of the handle 4.

21 Claims, 13 Drawing Sheets

U.S. PATENT DOCUMENTS

| | | | | |
|---|---|---|---|---|
| 6,153,277 | A * | 11/2000 | Chang | 428/35.2 |
| 6,158,910 | A | 12/2000 | Jolly et al. | |
| 6,237,193 | B1 * | 5/2001 | Skerker et al. | 16/430 |
| 6,247,204 | B1 | 6/2001 | Hamby et al. | |
| 6,308,378 | B1 * | 10/2001 | Mooty et al. | 16/430 |
| 6,338,290 | B1 | 1/2002 | Lin | |
| 6,591,456 | B2 * | 7/2003 | DeLuca et al. | 16/431 |
| 6,721,997 | B2 * | 4/2004 | Hua | 16/431 |
| 2002/0020537 | A1 | 2/2002 | Shonfeld et al. | |
| 2003/0024543 | A1 * | 2/2003 | Wolf | 132/212 |
| 2003/0110585 | A1 * | 6/2003 | Rechelbacher | 15/143.1 |
| 2004/0040120 | A1 * | 3/2004 | Zaidman | 16/436 |

FOREIGN PATENT DOCUMENTS

| | | | |
|---|---|---|---|
| DE | 1006359 | | 4/1957 |
| DE | 20002343 | | 5/2000 |
| DE | 10139771 | | 4/2002 |
| DE | 100 55 395 | A1 | 5/2002 |
| EP | 0429408 | | 5/1991 |
| EP | 0481245 | | 4/1992 |
| EP | 0738525 | | 10/1996 |
| EP | 0893335 | | 1/1999 |
| EP | 0995553 | | 4/2000 |
| EP | 0687152 | | 3/2001 |
| GB | 1464089 | | 2/1977 |
| JP | 61-209884 | | 9/1986 |
| JP | 7-205055 | | 8/1995 |
| JP | 10-191745 | | 7/1998 |
| SU | 477236 | | 10/1975 |
| WO | WO-94/19990 | | 9/1994 |
| WO | WO 02/30731 | A1 | 4/2002 |
| WO | 02/38341 | | 5/2002 |

* cited by examiner

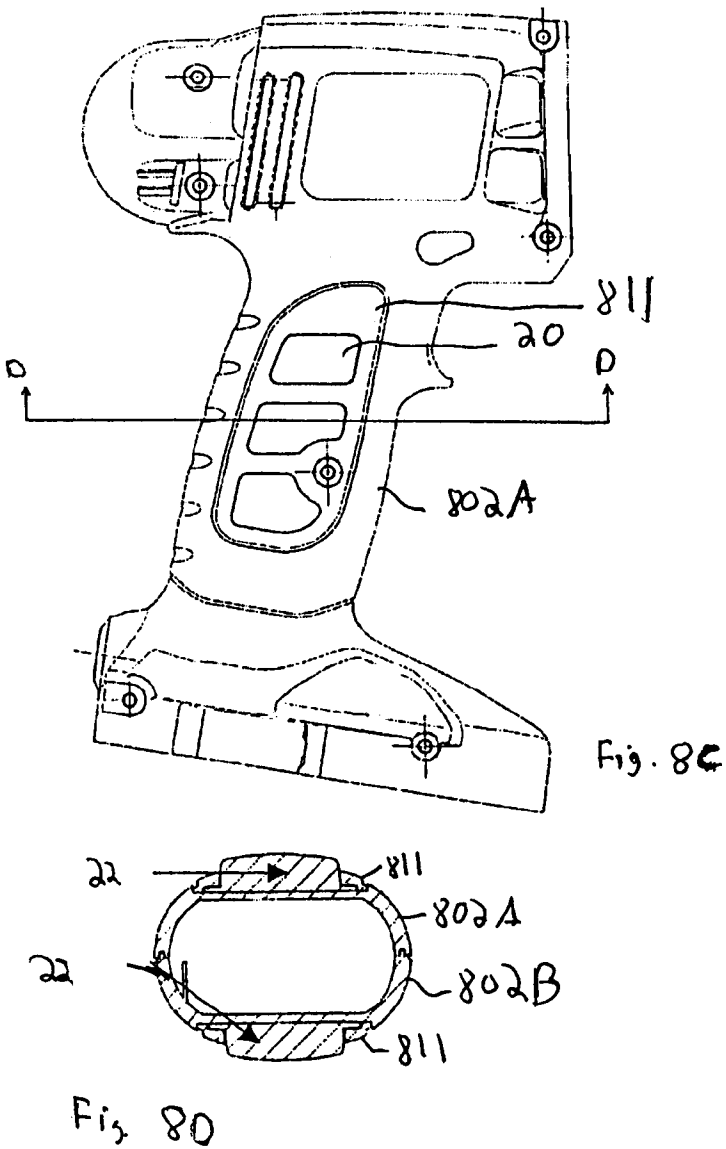
Fig. 8C
Fig. 8D
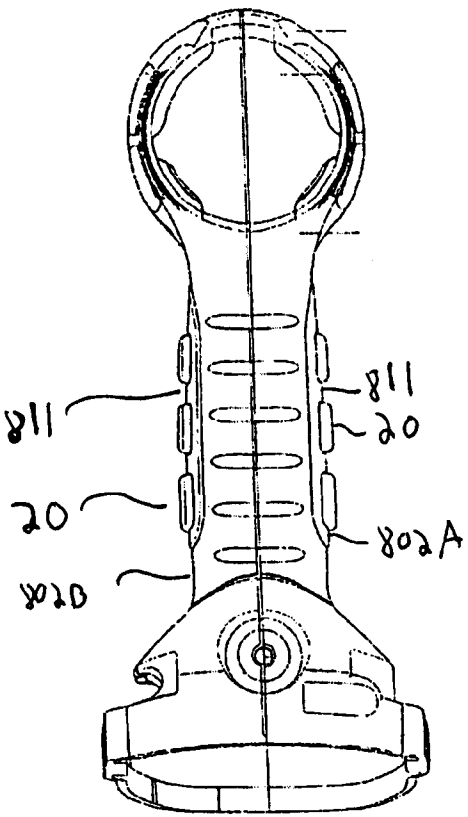
Fig. 8B

HANDLE ASSEMBLY FOR TOOL

The present invention relates to handle assemblies for tools, and relates particularly, but not exclusively, to handle assemblies having combined friction gripping and vibration damping properties, for power tools in which an output shaft is driven by a motor.

Known power tools, such as power drills in which a drill bit is rotated by an output shaft which is in turn rotated by means of an electric motor, generate significant amounts of vibration, which can under certain circumstances limit the length of time during which the tool can be used continuously. In addition, the housing of such tools is generally made from a durable plastics material on which it can be difficult for a user of the tool to maintain a grip when the tool is in use for a sustained period.

U.S. Pat. No. 6,308,378 discloses a gripping arrangement for a handle of a power tool in which the sides of the handle are provided with frictional gripping zones, each side of the handle including a plurality of alternating gripping zones of a softer material and a harder material. The softer material used is generally a thermoplastic elastomer or rubber material, and the harder material is generally the same material as that from which the tool housing is formed.

This known arrangement suffers from the drawback that because the softer material performs the dual functions of providing a friction grip and vibration damping, the choice of material constitutes a compromise in that although it will have acceptable friction reducing and vibration damping properties, the performance of the handle is limited because a material having optimum frictional properties will generally have unacceptable vibration damping properties, and vice versa.

WO02/38341 discloses a grip handle for a hand-held machine tool in which a hand grip is separated from the remainder of the housing by a vibration damping element consisting of an inflatable annular air filled cushion. An additional handle is provided which has a tubular grip element surrounding a further annular air cushion.

This known arrangement suffers from the drawback that the vibration damping properties of air can only be varied by adjusting the air pressure within a chamber containing the air, and even then, the range of vibration damping properties achievable is limited. Furthermore, it is difficult, and therefore expensive, to manufacture a sealed chamber containing air having a predetermined pressure.

Preferred embodiments of the present invention seek to overcome the above disadvantages of the prior art.

According to an aspect of the present invention, there is provided a gripping portion for a power tool having a housing and a motor within said housing for actuating an output member of the tool, the gripping portion adapted to be engaged by a hand of a user of the tool and comprising:

- at least one blister pack comprising respective first and second flexible sheets defining at least one gel-containing chamber therebetween, wherein the or each said gel-containing chamber contains a vibration damping gel material and said first and second sheets are sealed to each other at the periphery of the or each said gel containing chamber; and
- at least one clamping member for clamping at least one said blister pack to said housing and having at least one aperture therethrough such that at least one said gel-containing chamber protrudes in use through a respective said aperture and substantially none of said vibration damping gel is located in use between a said clamping member and the housing.

By providing at least one flexible member and at least one chamber containing at least one vibration damping gel material between the engaging portion and the surface of the handle in use, this provides the advantage of enabling the material of the flexible member to be chosen to have the optimum frictional properties to enable a user to maintain a grip on the tool, and the vibration damping gel material at the same time to have the optimum vibration damping properties. In particular, it is possible to provide gel materials having a wide range of vibration damping properties compared with air. This also provides the advantage of simplifying construction of the assembly, which in turn reduces the cost of manufacture of the assembly, as well as providing the advantage of further reducing the cost of manufacture of the assembly by providing one or more components which perform more than one function.

At least one said blister pack may be foldable.

This provides the advantage of enabling the blister pack to conform to the shape of the tool handle.

At least one said blister pack may be perforated between at least one pair of adjacent chambers.

This provides the advantage of facilitating folding of the blister pack.

At least one said blister pack may further comprise locating means for enabling the blister pack to be mounted to a support.

Said locating means may comprise at least one aperture through said blister pack at a respective location remote from the or each said chamber.

The assembly may further comprise support means adapted to be located on a side of at least one said blister pack remote from the corresponding said engaging portion.

At least one said chamber containing the or each said gel material may be at least partially transparent in use.

This provides the advantage of enabling visible indicia, such as decorative features or trade marks, or electrical indicators, for example indicating that the tool of which the assembly forms part is actuated, to be seen while the tool is in use.

The assembly may further comprise at least one visible indicium located in at least one said chamber.

At least one said visible indicium may be electrically operated in use.

This provides the advantage of enabling said indicium to provide an indication of an operating condition of a power tool, such as whether the tool is actuated.

At least one said indicium may be at least one light emitting diode.

The assembly may further comprise at least one electrical switch for actuating the tool.

This provides the advantage of simplifying assembly of the tool, which in turn further reduces the cost of manufacture of the tool.

According to another aspect of the present invention, there is provided a tool comprising:

- a housing;
- a motor within the housing adapted to actuate an output member of the tool; and
- a gripping portion as defined above.

Said gripping portion may have an outer surface including at least one material of higher coefficient of friction than the material of the housing of the tool.

Preferred embodiments of the invention will now be described, by way of example only and not in any limitative sense, with reference to the accompanying drawings, in which:

FIG. 8B is a view of the handle assembly of FIG. 8A in an assembled condition.

FIG. 8C is a side view of the tool shown in FIG. 8A.

FIG. 8D is a cross-section along the line D-D of FIG. 8C.

Figure 1:
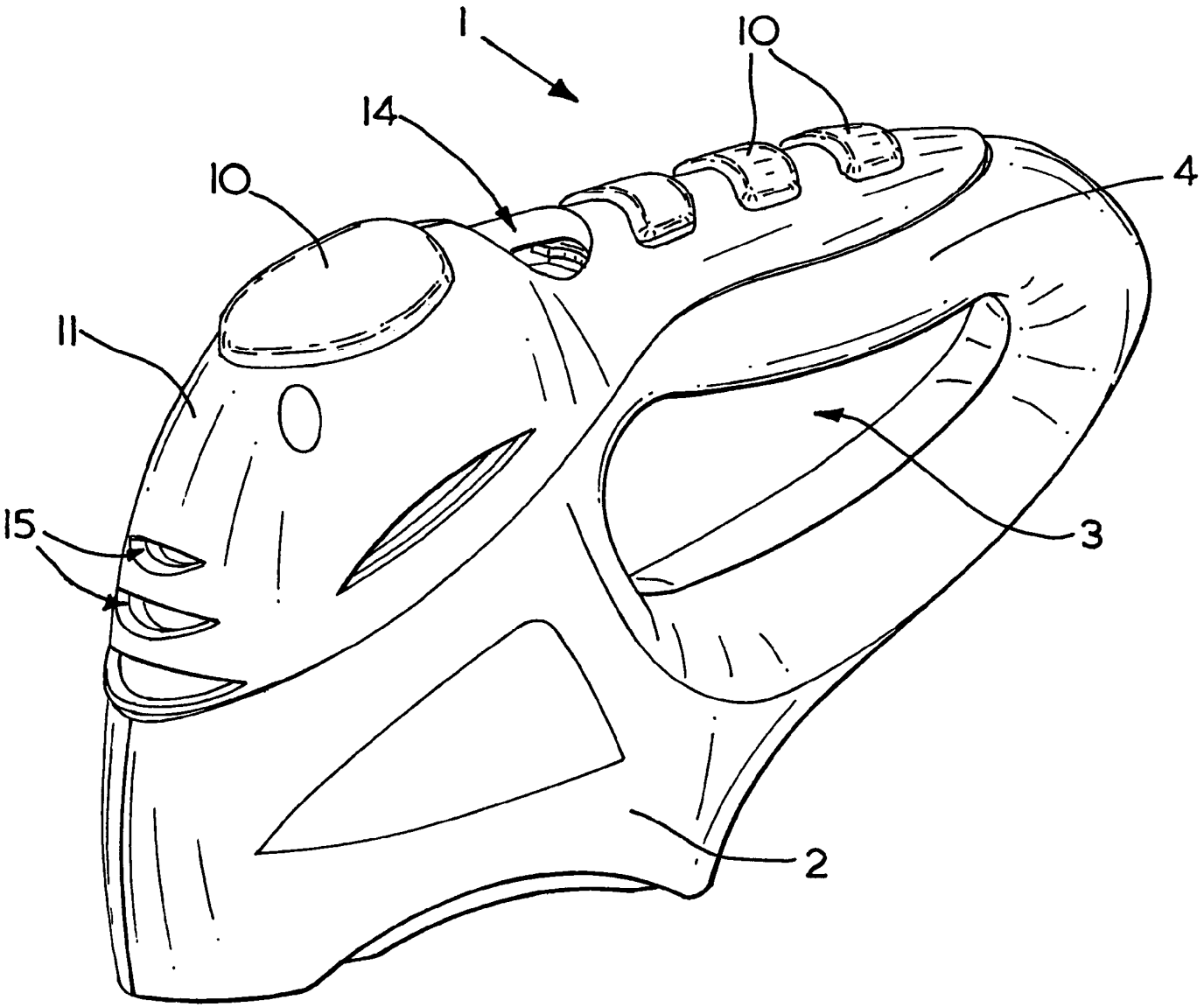
FIG. 1 is a perspective view of part of a housing of a power tool of a first embodiment of the present invention.
Figure 2:
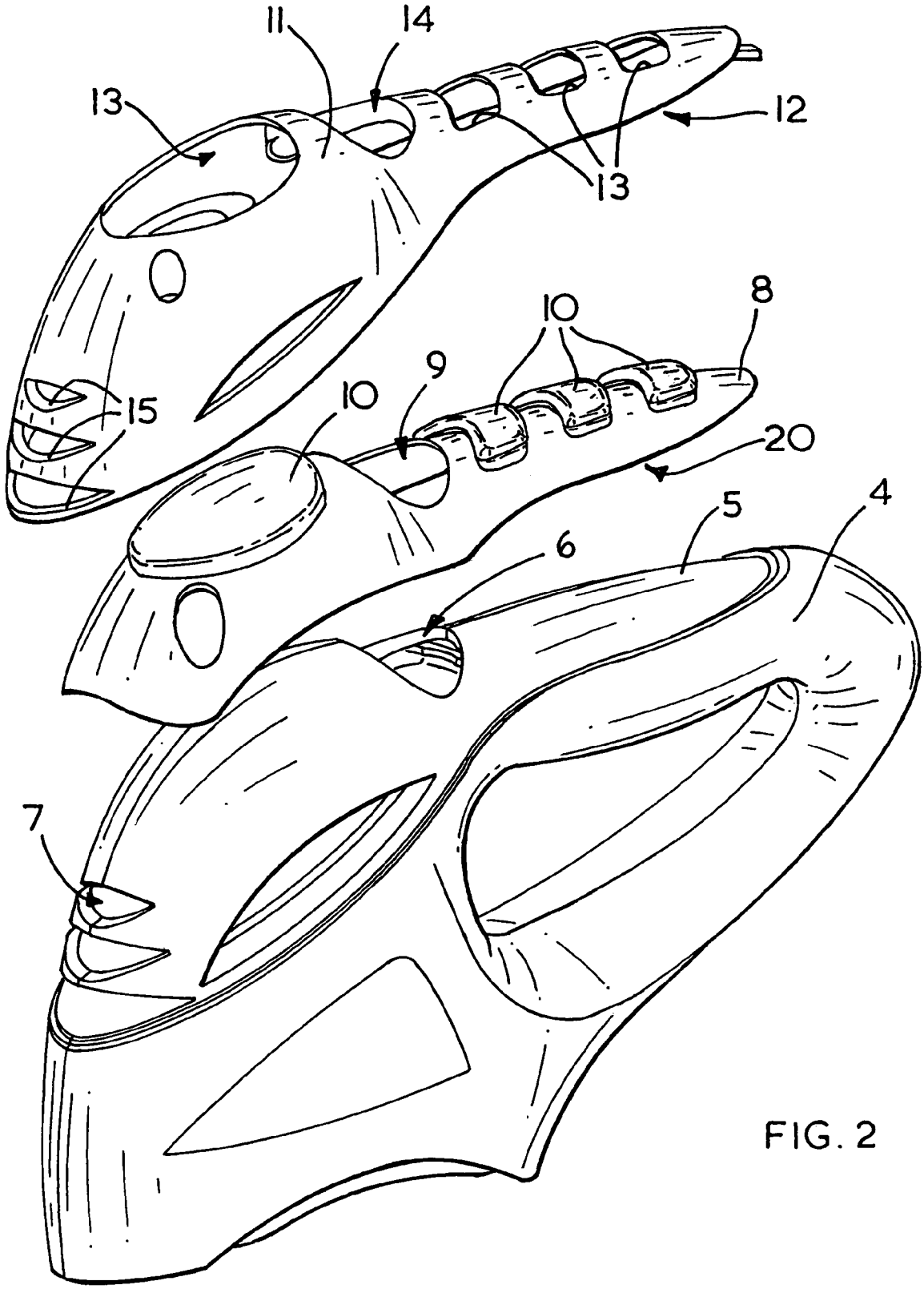
FIG. 2 is an exploded perspective view of the housing of the embodiment of FIG. 1.

Referring to FIGS. 1 and 2, a power tool 1 such as a drill or jigsaw comprises a housing 2 defining an aperture 3 bounded on one side thereof by a handle 4, the housing 2 containing a motor (not shown) for actuating an output member such as a drill bit or jigsaw blade (not shown).

The housing 2 is formed from a generally durable plastics material, as will be familiar to persons skilled in the art, and has a recessed portion 5 on a generally smooth upper surface of the handle 4, the recessed portion 5 being provided with a recess 6 containing an actuating switch (not shown) for turning the tool 1 on and off. The housing 2 is provided with ventilation apertures 7 at one end of the recessed portion 5 to allow cooling of the interior of the housing 2.

Figure 3A:
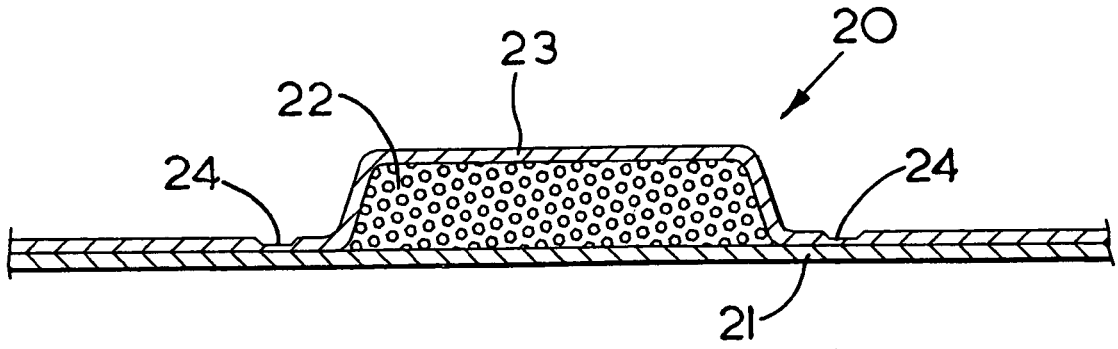
FIGS. 3A to 3C show side cross-sectional views of three alternative forms of gel blister pack for use in the embodiment of FIGS. 1 and 2.
Figure 3B:
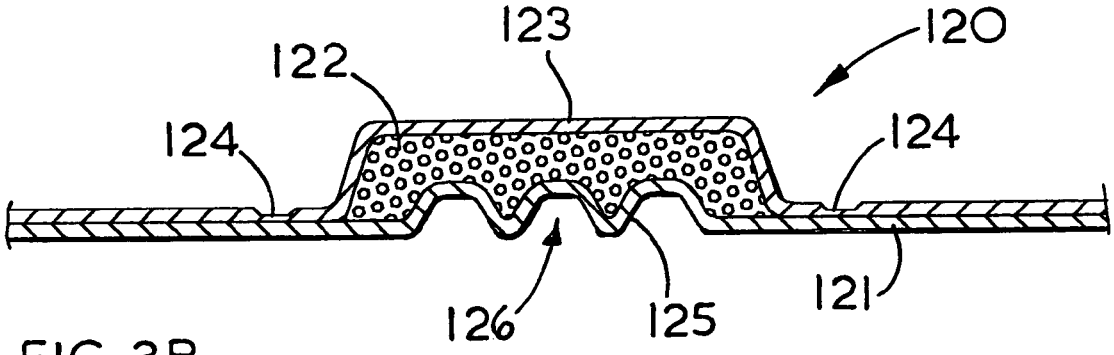
Figure 3C:
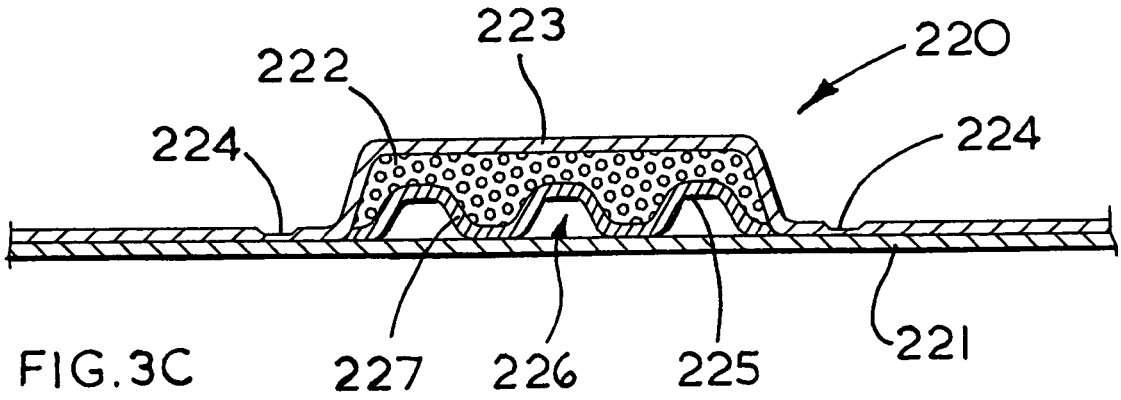

A flexible sheet 8, of thermoplastic elastomeric material, such as a thin layer of polyurethane, having a coefficient of friction higher than that of the material from which the housing 2 is made, is formed by means of a suitable method such as moulding. The sheet 8 has a periphery shaped to fit inside the periphery of recessed portion 5 to cover all of the recessed portion 5 except that part in which the ventilation apertures 7 are provided, and the flexible sheet 8 is provided with a through-aperture 9 to allow access to the actuating switch in recess 6. The flexible sheet 8 is also provided with a series of protrusions 10, each of which defines a chamber between the sheet 8 and the upper surface of the handle 4 of the housing 2 when the sheet 8 is placed in position on the upper surface of the recessed portion 5. Each of the chambers underneath the protrusions 10 accommodates a vibration damping gel contained in a blister pack 20 (FIGS. 3A to 3C). Alternatively, the flexible sheet 8 may be bonded to a backing sheet (not shown) to define the chambers containing the vibration damping gel.

A cover plate 11 of durable plastics material, such as the material from which the housing 2 is constructed, has an internal surface 12 corresponding generally to the external (i.e. upper) surface of the flexible sheet 8. The cover plate 11 is provided with a series of first apertures 13 for allowing the protrusions 10 of the sheet 8 to protrude therethrough when the plate 11 is mounted to the handle 4 to secure the flexible sheet 8 in place, a second aperture 14 co-operating with the aperture 9 to allow access to the actuating switch in recess 6, and a series of third apertures 15 cooperating with the ventilation apertures 7 in the housing 2.

Referring now to FIG. 3A, a gel blister pack 20 for use in the embodiment of FIGS. 1 and 2 is formed from a thin, flexible backing piece 21 of thermoplastic polyurethane film on which one or more pieces 22 of a vibration damping gel formed from a semi-solid silicone rubber or polyurethane material are provided. The pieces 22 of gel may be translucent and/or semi transparent and/or coloured, for reasons which will be explained in greater detail below. The backing layer 21 with the pieces 22 of gel are then covered by a generally transparent layer 23 of thin, thermoplastic polyurethane film, which is pulled down tightly over the gel pieces 22 by means of a combination of heat and pressure, and then secured to the backing piece 21 at the periphery 24 of each gel piece 22 to form discrete chambers encapsulating each gel piece by suitable welding techniques, such as heat staking and/or ultrasonic vibration, which will be familiar to persons skilled in the art. Alternatively, the gel material 22 can be poured or injected into a pre-formed transparent sheet 23 and then covered by backing piece 21 and welded. The upper surface of the backing piece 21 may be printed with decorative or trade mark information which is visible through the transparent layer 23 and gel 22.

Referring to FIG. 3B, in which parts common to the embodiment of FIG. 3A are denoted by like reference numerals but increased by 100 and will therefore not be described in greater detail herein, the backing piece 121 of the blister pack 120 is provided with a series of raised portions 125 which may be decorative matter and/or trade marks or raised lettering. The raised portions 125 define recesses 126, which may accommodate light emitting diodes which can be illuminated to provide a visual indication of an operating parameter of the tool incorporating the blister pack 120, for example to indicate whether the tool is switched on.

In the arrangement of FIG. 3C, in which parts common to the embodiment of FIG. 3B are denoted by like reference numerals but increased by 100, the raised portions 225 defining recesses 226 may be formed by a separate layer 227, which is encapsulated along with gel material 222 by transparent sheet 223 and backing piece 221.

The operation of the handle 4 of the tool 1 of FIGS. 1 to 3 will now be described.

When a user's hand (not shown) grips the tool 1 when in use, the user's hand comes into contact with the cover plate 11 and the protrusions 10 beneath which one or more blister packs 20, 120, 220 containing vibration damping gel are located. As a result, vibrations generated by the motor in the tool housing 2 are damped by the vibration damping gel underneath protrusions 10, and the user's grip on the tool is maintained by contact between the user's hand and the high friction material of the flexible sheet 8. It can therefore be seen that by suitable choice of material of the flexible sheet 8, the frictional properties of the sheet 8 can be optimized, while the vibration damping properties of the gel-filled blister packs 20, 120, 220 are generally superior to the vibration damping properties of known high friction materials or air filled cushions used in conventional handle assemblies.

Figure 1A:
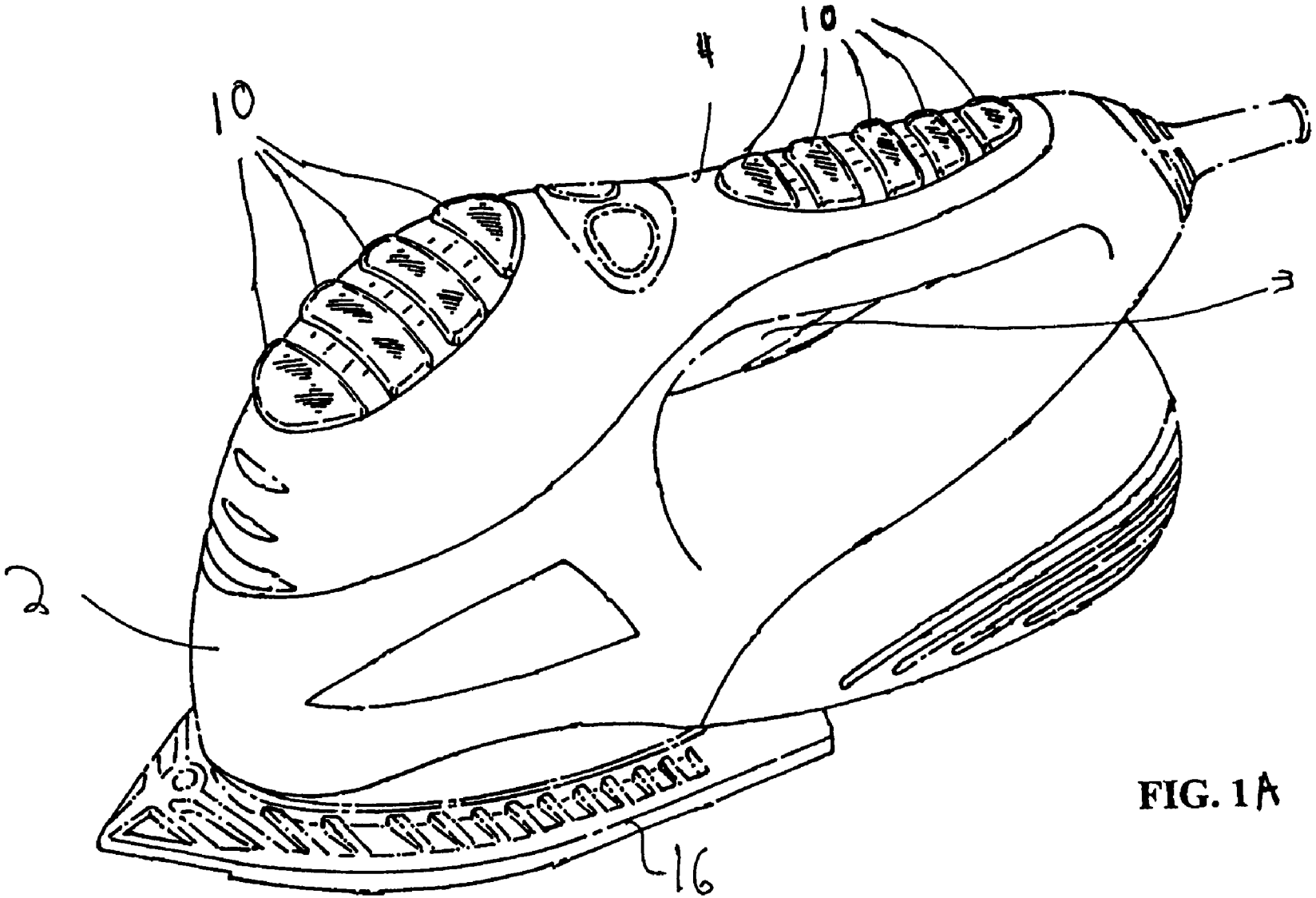
FIGS. 1A and 1B are perspectives view showing alternative arrangements of a power tool according to the first embodiment.

With reference to FIG. 1A, an alternative arrangement for the placement of protrusions 10 accommodating gel pieces 22 on the handle is shown. As shown, housing 2 may form part of a sander including sanding platen 16. Handle 4 includes a forward part formed on the housing at a location generally above platen 16. A motor (not shown) is disposed between the forward part of handle 4 and platen 16. Four gel pieces 22 disposed below corresponding protrusions 10 are disposed on the forward part of handle 4. Five gel pieces 22 are disposed on the rearward part of the handle formed above aperture 3.

Figure 1B:
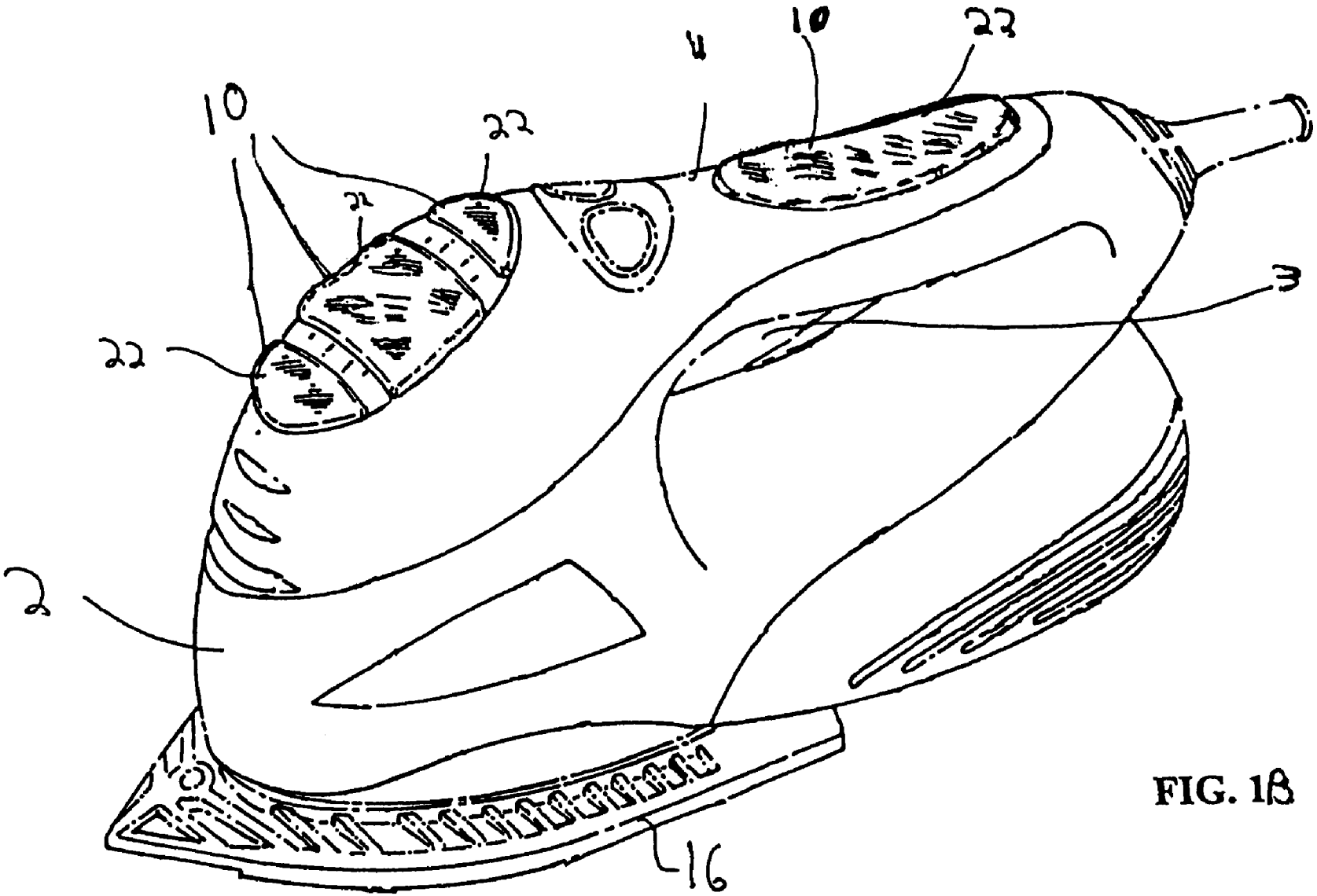

In a further alternative embodiment as shown in FIG. 1B, three gel pieces 22 are disposed on the forward part of handle 4 and a single oval shaped gel piece 22 is disposed on the rearward part of the handle. Although in FIG. 1B a cover plate is represented, in practice the cover plate could be eliminated and the blister pack could be retained behind the outer surface of the tool housing, with gel pieces 22 protruding through openings in the housing surface. In this latter embodiment, with respect to the forward part of handle 4, the rearward and forward gel pieces 22 are generally half-moon shaped and may have a dimension in the longitudinal direction of the handle of 15 mm at the maximum region (along the center of the handle) and a maximum transverse width of 23.5 mm (along the flat edge.) The thickness of each gel piece 22 may be 12 mm. The middle gel piece 22 may have a dimension in the longitudinal direction of 15 mm and has a transverse width of 30 mm and thickness of 14 mm. The exposed region of the housing between the gel pieces may have a dimension of 8 mm in the longitudinal direction and the openings of the housing may have dimensions corresponding to that of the gel piece protruding therethrough. The housing at the location of middle gel piece 22 may have a maximum transverse width of 65 mm. Gel piece 22 on the rear handle portion may have a longitudinal dimension of 65 mm, a transverse width of 20 mm and a thickness of 17 mm. The transverse width of the rear handle portion may be 35 mm and the longitudinal dimension between the rear end of the gel piece and the end of the rear handle portion may be 38 mm. In each case, gel pieces 22 may protrude outwardly from the surface of the housing for a distance of approximately 2.5 mm at the outer boundary of each gel piece increasing to a distance of approximately 5 mm near the center of each gel piece 22.

Figure 4B:
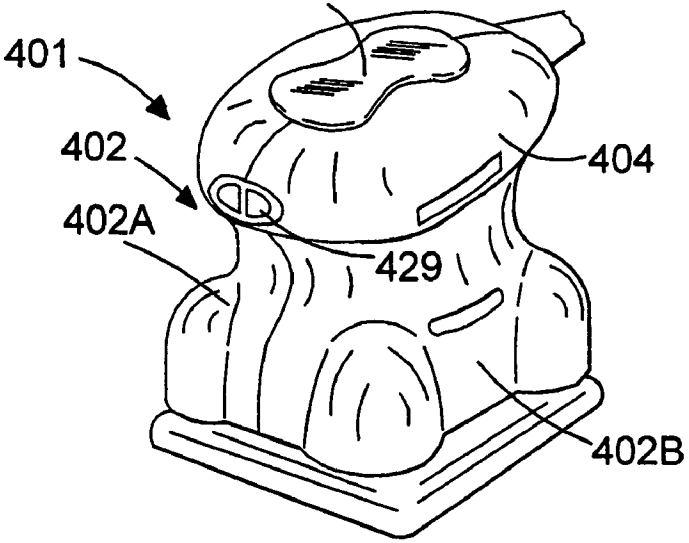
FIG. 4B is a view of the handle assembly of FIG. 4A in an assembled condition.
Figure 4C:
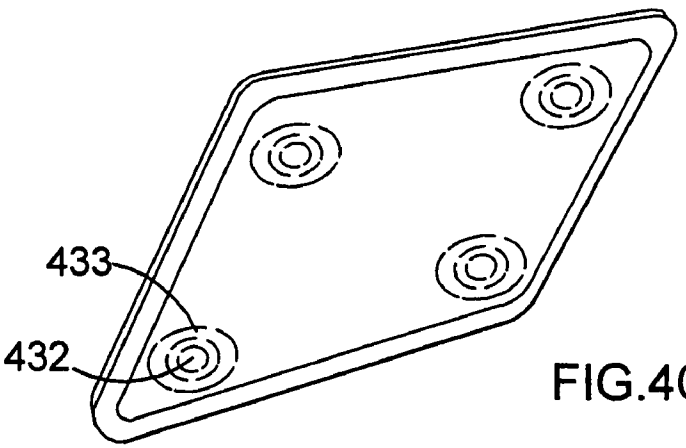
FIG. 4C is a perspective view from below of the cover plate of FIG. 4A.
Figure 4A:
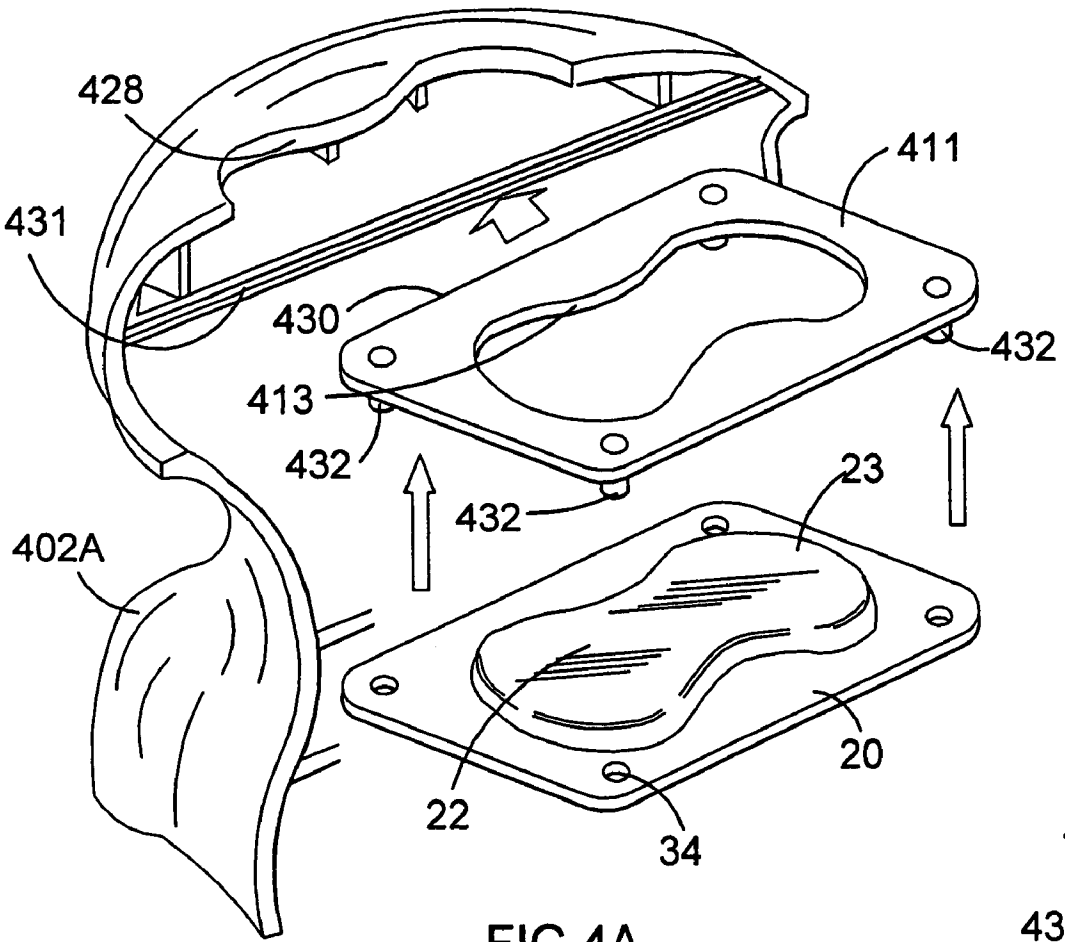
FIG. 4A is an exploded view of a handle assembly of a power tool of a second embodiment of the present invention.

Referring to FIGS. 4A to 4C, in which parts common to the embodiment of FIGS. 1 and 2 are denoted by like reference numerals but increased by 400, a handle 404 of a power tool 401 of a second embodiment of the invention, for example a sander, is defined by two halves 402A, 402B of housing 402 around ON/OFF switch 429. The housing 402 defines an aperture 428 which enables the transparent layer 23 of the blister pack 20 of FIG. 3A to protrude therethrough, and the blister pack 20 is mounted to a cover plate 411 of hard plastics material by means of pegs 432 provided on cover plate 411 which are located in corresponding apertures 34 on blister pack 20 externally of gel material 22 and then deformed or heat staked to provide flattened portions 433 (FIG. 4C) to prevent removal of the blister pack 20 from cover plate 411. The apertures 34 may be reinforced by welding together the adjacent parts of the backing piece 21 and transparent layer 23. The cover plate 411 is then located in position relative to the housing 402 by locating an edge 430 of the cover plate 411 in a slot 431 in housing part 402A, and the opposite edge in a corresponding slot (not shown) in housing part 402B. In this embodiment, cover plate 411 is disposed within housing 402.

Figure 5B:
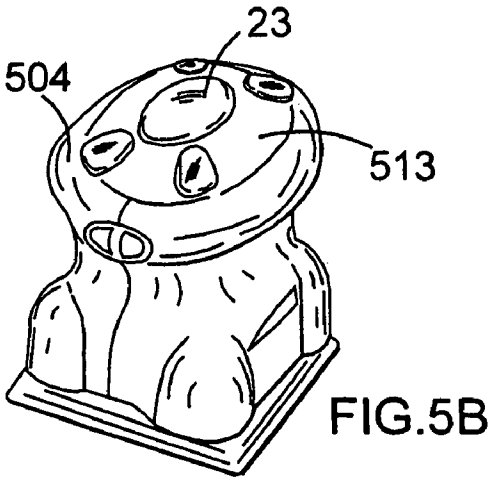
FIG. 5B is a view of the handle assembly of FIG. 5A in an assembled condition.
Figure 5A:
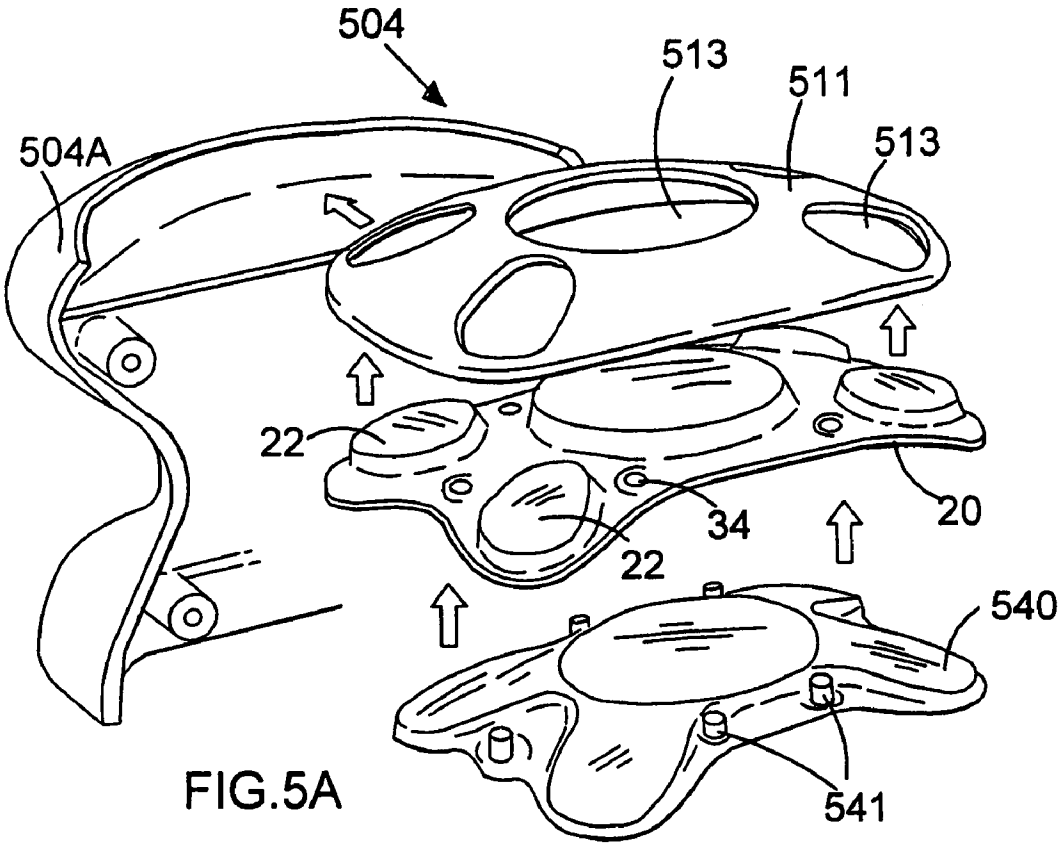
FIG. 5A is an exploded view, corresponding to FIG. 4A, of a handle assembly of a power tool of a third embodiment of the present invention.

Referring now to FIGS. 5A and 5B, in which parts common to the embodiment of FIGS. 4A to 4C are denoted by like reference numerals but increased by 100, a handle assembly 504 of a third embodiment of the invention is provided with a support or carrier 540 of molded hard plastics material having pegs 541 which are located in corresponding apertures 34 of blister pack 20 to mount the blister pack 20 to the carrier 540. The pegs 541 of carrier 540 interconnect with circular bosses (not shown) of cover plate 511 to locate the blister pack 20 between the carrier 540 and cover plate 511 with the transparent sheet 23 covering gel material 22 protruding through apertures 513 in cover plate 511.

Figure 6B:
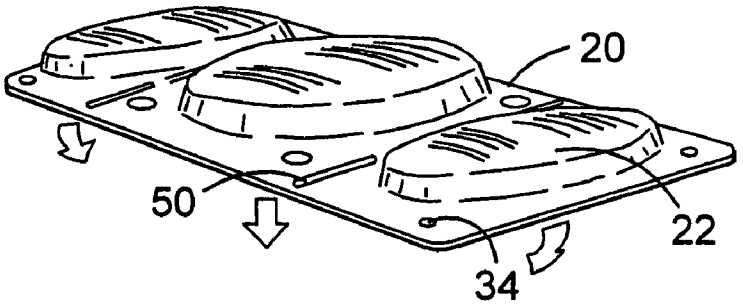
FIG. 6B is a perspective view of the blister pack of FIG. 6A in an unfolded condition thereof.
Figure 6A:
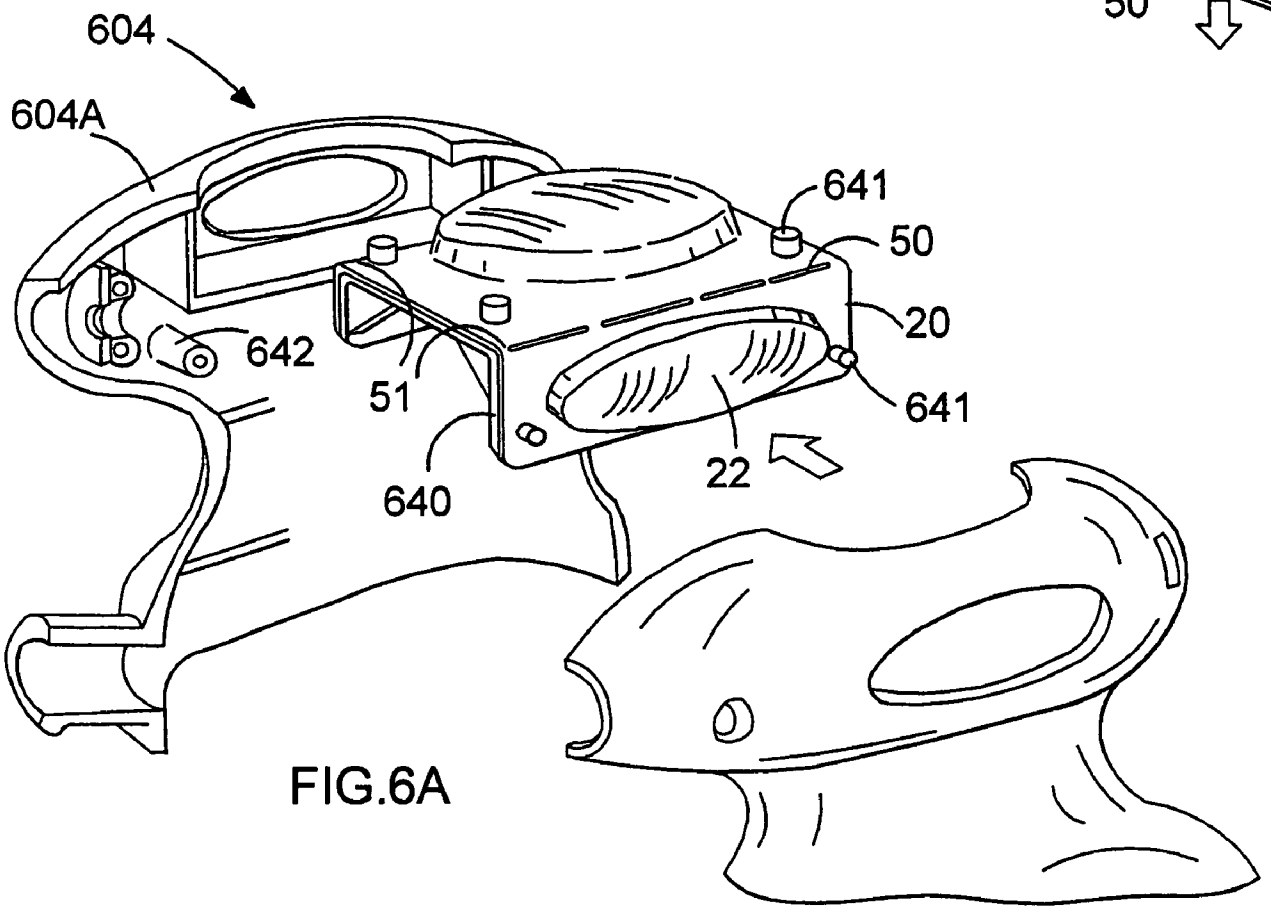
FIG. 6A is an exploded view, corresponding to FIG. 4A, of a handle assembly of a power tool of a fourth embodiment of the present invention.

A handle assembly 604 of a fourth embodiment of the invention is shown in FIG. 6A, in which parts common to the embodiment of FIGS. 5A and 5B are denoted by like reference numerals but increased by 100. The blister pack 20 is provided with perforations 50 along lines 51 to enable the blister pack 20 to be folded along lines 51. This enables the blister pack 20 to be mounted to carrier 640 of generally inverted right-angled U-shape and secured to the carrier 640 by location of pegs 641 through apertures 34. The pegs 641 can also interconnect with cylindrical bosses 642 in the handle 604 to secure the support 640 in position in the housing. In this way, the gel material 22 of the blister pack 20 can provide vibration damping in more than one plane. In particular, gel pieces 22 protrude through the top and side surfaces of the handle. In one embodiment of handle assembly 604 which includes only a gel piece 22 protruding through a top surface but not the side surfaces, gel piece 22 is oval and may have a maximum longitudinal dimension along the centerline of 80 mm, a transverse width of 52 mm and a thickness of 16 mm. The opening in the handle to accommodate gel piece 22 has corresponding dimensions. Gel piece 22 may protrude outwardly from the surface of the housing for a distance of approximately 2.5 mm at the outer boundary of the gel piece increasing to a distance of approximately 5 mm near the center of the gel piece 22. The maximum transverse width of the handle may be 77 mm.

Figure 7:
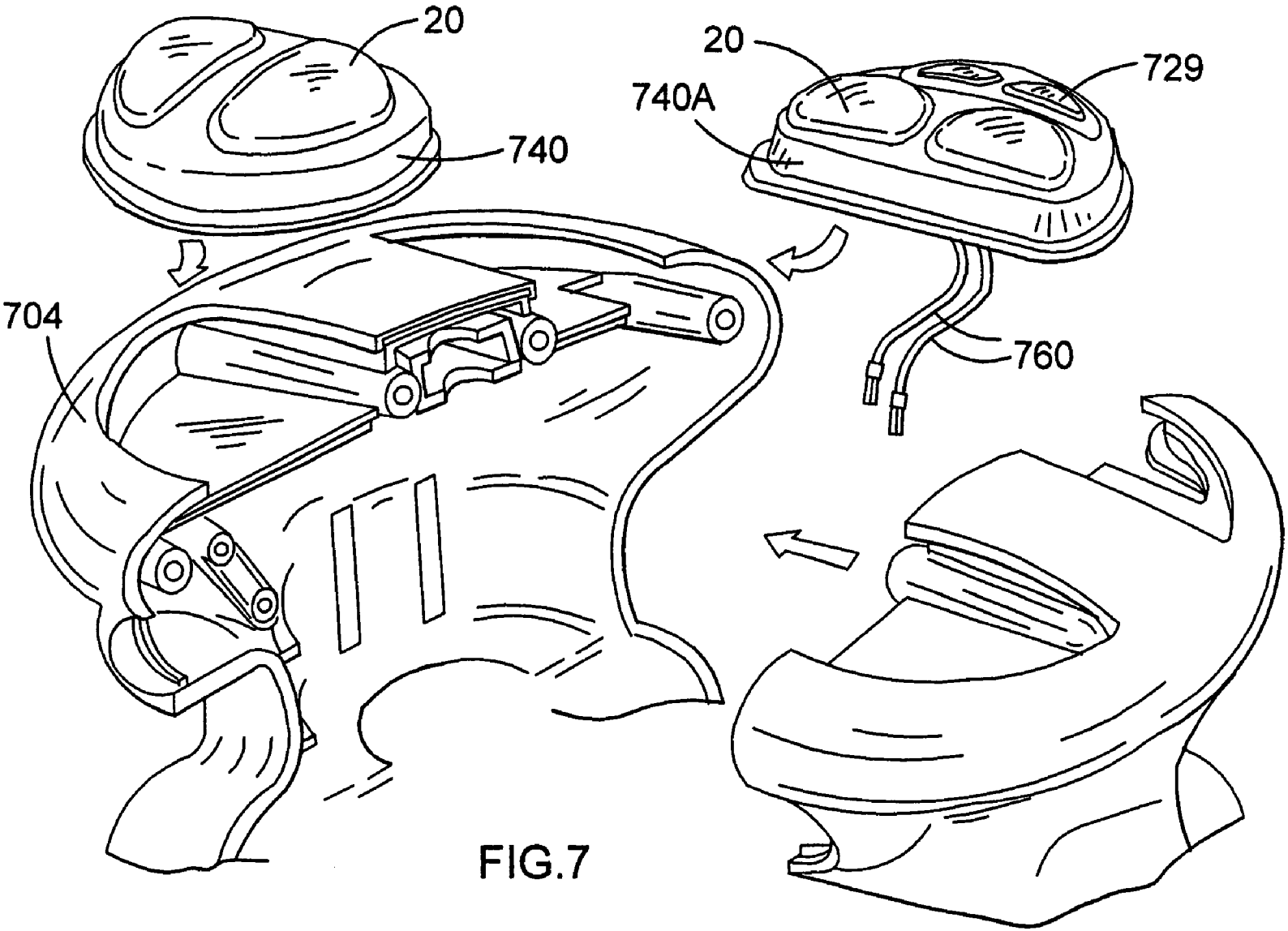
FIG. 7 is an exploded view, corresponding to FIG. 4A, of a handle assembly of a power tool of a fifth embodiment of the present invention.

Referring now to FIG. 7, in which parts common to the embodiment of FIG. 6A are denoted by like reference numerals but increased by 100, a handle assembly 704 of a fifth embodiment of the invention is provided with a pair of vibration damping blister packs 20 mounted to respective supports 740, 740A. The carrier 740A is also provided with an ON/OFF switch 729 for actuating the tool and which can be connected to the power supply (not shown) of the tool by means of electrical leads 760. This enables the carrier 740A together with the switch 729 to be mounted to the housing 704 as a complete module or assembly, which simplifies assembly of the tool and therefore reduces the cost of manufacturing the tool.

Referring to FIGS. 8A to 8D, in which parts common to the embodiment of FIG. 7 are denoted by like reference numerals but increased by 100, a handle 804 of a power tool 801 of a sixth embodiment of the invention, for example a drill, is defined by two halves 802A, 802B of housing 802. Each halve 802A and 802 defines a recessed portion 805 which accommodates a blister pack 20 having three discrete gel pieces 22. Cover plates 811 of hard plastics material include screw bossed (unnumbered) and are secured to each housing half at the location of the recessed portions 805.

Each cover plate 811 includes an appropriate aperture though which a corresponding gel piece 22 extends. Although not shown, a separate flexible sheet such as sheet 8 shown in FIG. 2 could also be disposed between the upper surface of blister packs 20 and cover plates 811 and would include protrusions 10 to accommodate each gel piece 22. Cover plates 811 are curved so as to substantially match the outer surface of the corresponding housing halves lateral of recesses 805, with the cover plates 811 and the corresponding housing half merging to form a substantially curved outer surface from which the gel pieces extend. The outer surfaces of the gel pieces may be curved as well. With reference to FIG. 8C, in one embodiment the dimension of the middle and lower gel piece 22 at their greatest extent in the longitudinal direction of the handle may be 17 mm while for the upper gel piece 22 the dimension may be 16 mm. The distance between gel pieces 22 in the longitudinal direction may be 5 mm. The dimension of the upper and lower gel piece 22 at their greatest extent in the transverse direction of the handle may be 20 mm while for the middle gel piece 22 the transverse dimension may be 23 mm. The openings in cover plates 811 have dimensions corresponding to those of gel pieces 22, while the overall dimension of cover plates 811 may be 75 mm in the longitudinal direction and 33 mm in the transverse direction. As measured in a vertical direction, the overall distance from the upper edge of the cover plate 811 to the lower edge may be 70 mm, the overall distance from the upper edge of the uppermost gel piece 22 to the lower edge of the lowermost gel piece 22 may be 58 mm, and in the horizontal direction the overall distance from the left edge of the lowermost gel piece 22 to the right edge of the uppermost gel piece 22 may be 30 mm. The thickness of gel pieces 22 may be 5 mm and gel pieces 22 may project outwardly from cover pieces 811 by 2.5 mm.

Figure 8A:
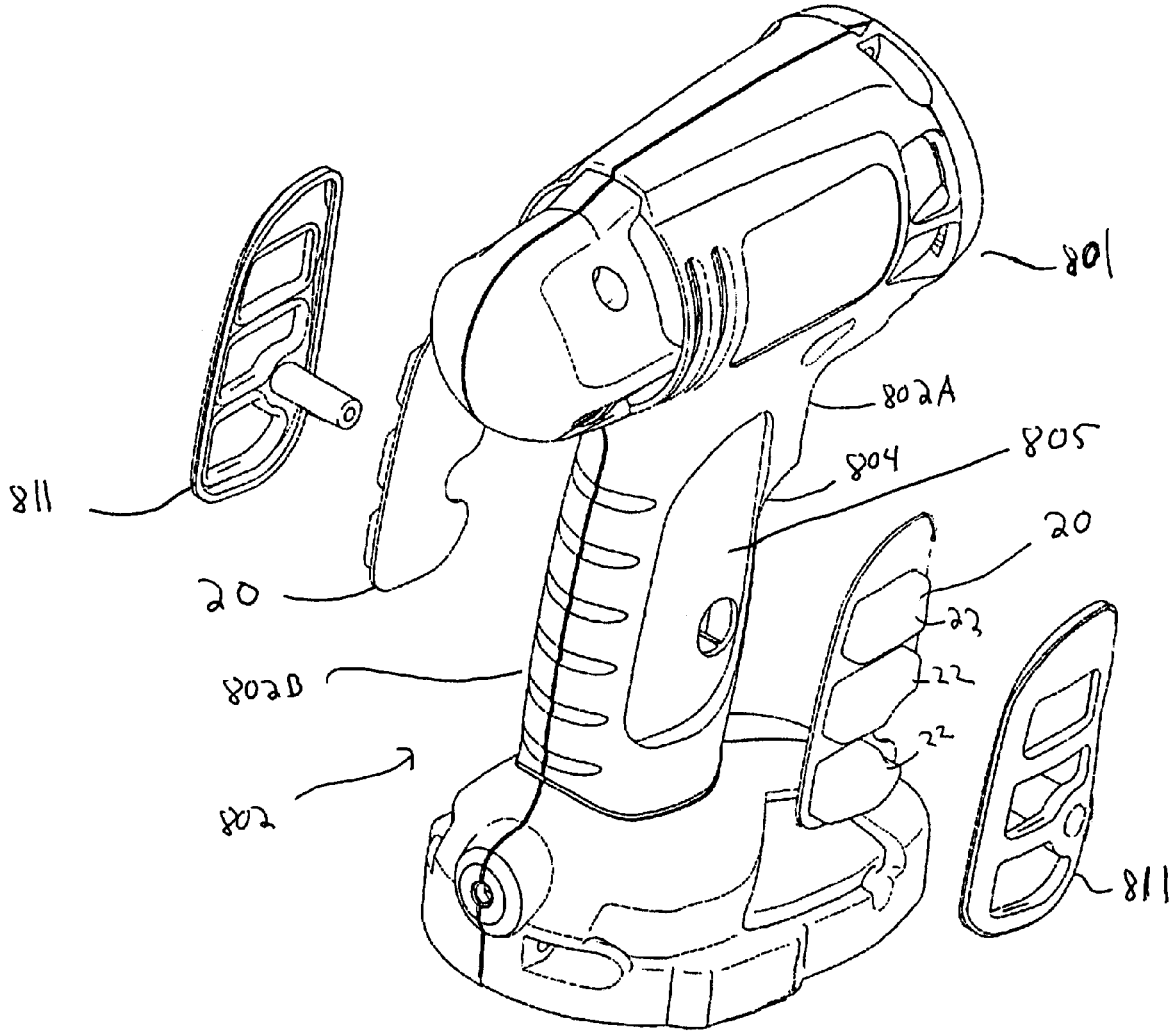
FIG. 8A is an exploded view, corresponding to FIG. 4A, of a handle assembly of a power tool of a sixth embodiment of the present invention.
Figure 8E:
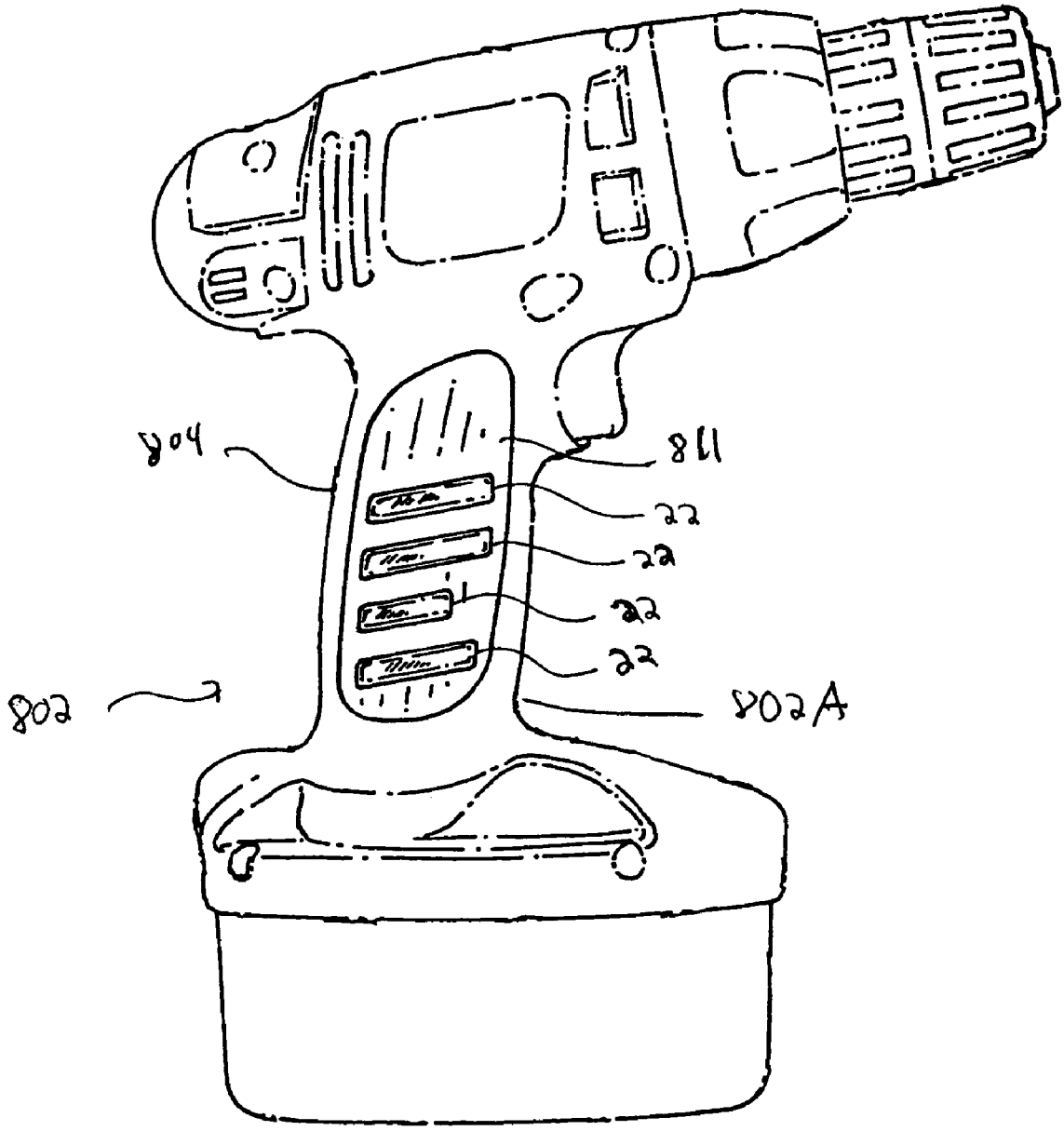
FIG. 8E is a side view showing an alternative arrangement of the tool shown in FIG. 8A.

FIG. 8E shows an alternative to the drill embodiment of FIGS. 8A-D. Blister pack 20 include four gel pieces 22 protruding from each side surface of handle 804.

Figure 9:
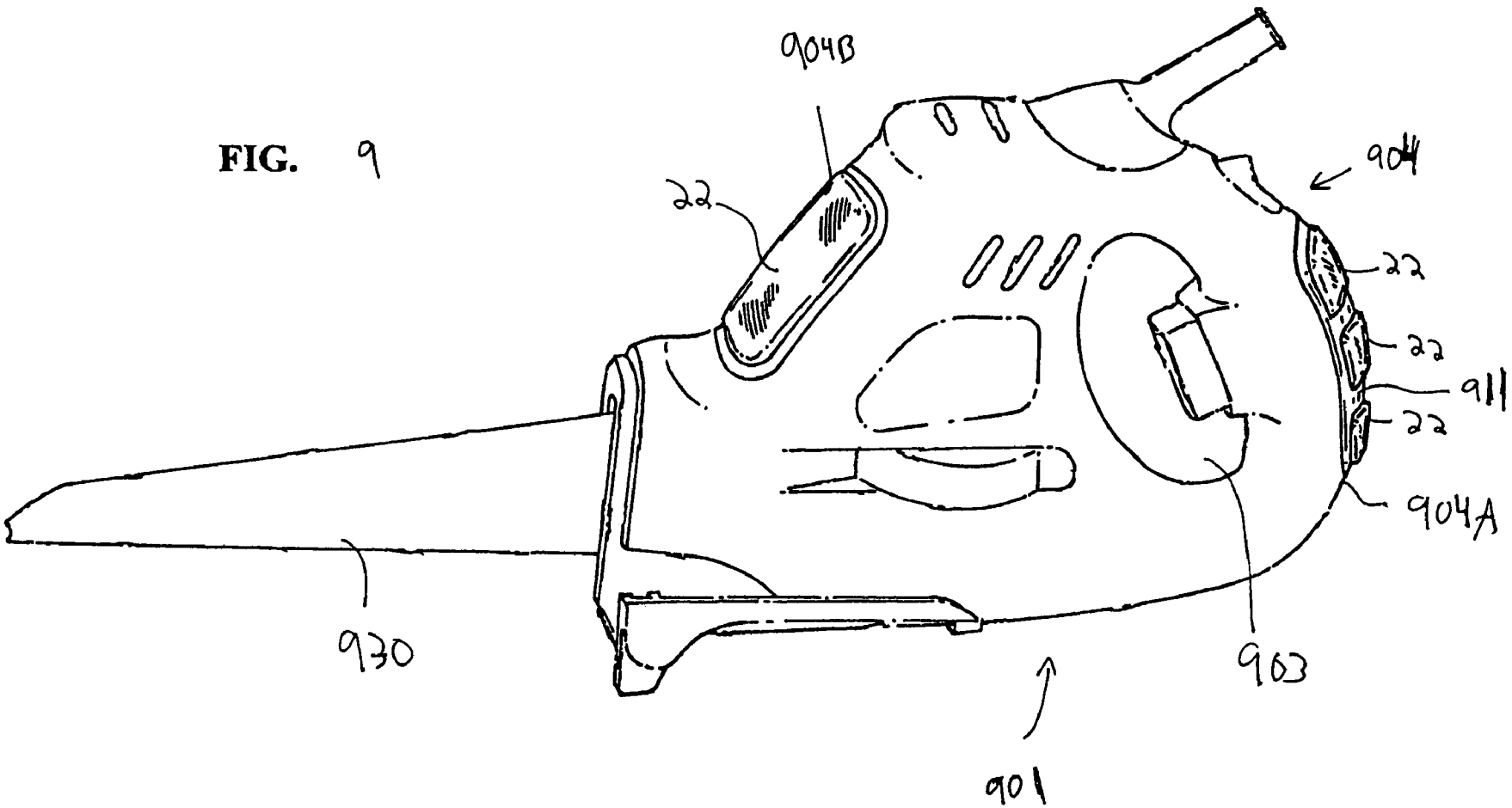
FIG. 9 is a perspective view of a handle according to a seventh embodiment of the present invention.

Referring to FIG. 9 in which parts common to the embodiment of FIGS. 8A-8D are denoted by like reference numerals but increased by 100, a handle 904 of a power tool 901 of a seventh embodiment of the invention, for example a saw is shown. The saw includes a housing having a motor for reciprocating a drive shaft (not shown) to which saw blade 930 is attached to extend from a forward end. Opening 903 extends through the housing to form vertically extending rear handle portion 904A. Blister pack 20 includes three gel pieces 22 extending outwardly from the rear surface of rear handle portion 904A. In a preferred embodiment, gel pieces 22 may have a longitudinal dimension (along the vertical length of the rear handle) of 26 mm and a transverse width of 17.5 mm, and a thickness of 9 mm. The spacing between each gel piece 22 may be 5 mm. Cover plate 911 is disposed over blister pack 20 and has three apertures through which gel pieces 22 protrude. Each opening may have a longitudinal dimension of 27 mm and a transverse width of 18 mm and the spacing between each opening may be 6 mm. Forward handle portion 904B is disposed generally forwardly of the motor and sloped downwardly towards the blade. Blister pack 20 includes gel piece 22 extending outwardly from forward handle portion 904B. In a preferred embodiment, this gel piece 22 has a vertical length along the slope of 60 mm, a transverse width of 30 mm and a thickness of 20 mm. The opening of the housing also may have a vertical length along the slope of 60 mm and a transverse width of 30 mm In addition, an internal cover plate (not shown) similar to cover plate 411 shown in FIG. 4A may be incorporated between gel piece 22 and the housing at the location of forward handle portion 904B. In each case, gel pieces 22 may protrude outwardly from the surface of the housing for a distance of approximately 2.5 mm at the outer boundary of each gel piece increasing to a distance of approximately 5 mm near the center of each gel piece 22

It will be appreciated skilled in the art that the above embodiments have been described by way of example only, and not in any limitative sense, and that various alterations and modifications are possible without departure from the scope of the invention as defined by the appended claims.

The invention claimed is:

1. A tool comprising:

a housing;

a motor within the housing adapted to actuate an output member of the tool; and a gripping portion adapted to be engaged by a hand of a user of the tool and comprising:

at least one blister pack comprising respective first and second flexible sheets defining at least one gel-containing chamber therebetween, wherein said at least one gel-containing chamber contains a vibration damping gel material and said first and second sheets are sealed to each other at the periphery of the at least one said gel-containing chamber; and at least one clamping member for clamping said at least one blister pack to said housing, said at least one clamping member having at least one aperture therethrough such that said at least one gel-containing chamber protrudes, in use, through a respective said at least one aperture and none of said vibration damping gel is located, in use, between a bottom surface of said clamping member and the housing, and said clamping member further including a fastening mechanism for securing said clamping member with said housing for covering a portion of said housing and said clamping member providing a surface the housing adjacent said at least one blister pack.

2. A tool according to claim 1, wherein said gripping portion has an outer surface including at least one material of higher coefficient of friction than the material of the housing of the tool.

3. A power tool comprising a housing having a handle and a motor to actuate an output member of the tool, said handle comprising a gripping portion and a chamber enclosing a gel material extending outwardly from said gripping portion, said chamber formed from a pair of flexible sheets, said gel-containing chamber contains a vibration damping gel material and said first and second sheets are sealed to each other at the periphery of the gel-containing chamber, said gripping portion surrounding said chamber and clamping said chamber and said flexible sheets in said handle, such that said gel-containing chamber protrudes, in use, from said gripping portion and none of said vibration damping gel is located, in use, between a bottom surface of said gripping portion and the housing, a fastener mechanism further securing said gripping portion to said handle such that said chamber is disposed relative to the gripping portion and said chamber positioned on said gripping portion for enabling parts of the user's hand, such as fingers, to contact the gripping portion and other parts, such as palm or heel, to contact the chamber for providing a dampening function for the user such that both the gripping portion, which provides a surface adjacent the chamber, and the chamber are simultaneously gripped during operation of the tool.

4. The power tool recited in claim 3, said gripping portion comprising a material which is relatively hard as compared to said gel material.

5. The power tool recited in claim 3, said handle further comprising a cover piece made of a material which is relatively hard as compared to said gel material, said cover piece including an aperture through which said chamber protrudes, said cover piece forming at least a part of said gripping portion of said handle at the location of said cover piece.

6. The power tool recited in claim 5, said chamber formed as a blister pack assembly including said gel material enclosed between upper and lower layers of flexible film, said blister pack assembly retained on said handle by said cover piece.

7. The power tool recited in claim 6, said handle defining a recess, said blister pack assembly disposed in said recess.

8. The power tool recited in claim 6 further comprising a flexible sheet, said flexible sheet disposed between said blister pack and said cover piece and having a protrusion extending through said aperture and accommodating said chamber.

9. The power tool recited in claim 5 including a second said chamber enclosing a gel material, said two chambers of gel material discrete from each other, said cover piece having two apertures, each said chamber protruding through one of said apertures.

10. The power tool recited in claim 5, said chamber and said cover piece each having a curved outer surface.

11. The power tool recited in claim 5, said handle gripping portion including a region which does not include said cover piece, said region being curved, said cover piece having a curved outer surface which substantially merges into said curved region.

12. The power tool recited in claim 3, said chamber formed as a blister pack assembly including said gel material enclosed between upper and lower layers of flexible film.

13. The power tool recited in claim 12, said chamber and said handle gripping portion each having a curved outer surface.

14. The power tool recited in claim 3, said tool comprising a drill and said handle comprising a drill handle, said gripping portion comprising opposite side surfaces of said drill handle, said chamber comprising two said chambers discreet from each other, one said chamber extending outwardly from each said side surface.

15. A power tool comprising:

a housing having a handle;

a motor positioned in said housing, said motor to actuate an output member of the tool;

a pair of flexible sheets defining a chamber enclosing a gel material, said gel-containing chamber contains a vibration damping gel material and said pair of flexible sheets are sealed to each other at the periphery of the gel-containing chamber, said pair of flexible sheets disposed on said handle;

and a cover piece made of a material which is relatively hard as compared to said gel material, said cover piece disposed on said handle for clamping said flexible sheets with said housing, said cover piece including an aperture through which said chamber protrudes and none of said vibration damping gel is located, in use, between a bottom surface of said cover piece and the handle, and said cover piece further including a fastening mechanism for securing said cover piece with said housing for covering a portion of said housing and said cover piece providing a surface adjacent said chamber.

16. The power tool recited in claim 15, wherein said chamber is formed in a respective blister pack.

17. A power drill comprising:

a main body;

a handle having opposite side surfaces each defining a gripping region;

two chambers encapsulating a gel material, each said chamber formed from a pair of flexible sheets, said two gel-containing chambers contain a vibration damping gel material and each pair of flexible sheets are sealed to each other at the periphery of the gel-containing chamber, one said chamber protruding outwardly from said gripping region of each said opposite side surface, said chambers discreet from each other; and said drill further comprising two cover pieces having an aperture therethrough such that said gel-containing chambers protrude, in use, through a respective aperture and none of said vibration damping gel is located, in use, between a bottom surface of said respective cover piece and the handle, and a fastening mechanism further securing said cover pieces to said handle, one said cover piece disposed on each said opposite side surface clamping said flexible sheets with said handle, said cover piece defining at least a portion of the gripping region of the handle at the locations of said cover pieces, each said chamber protruding through one said aperture.

18. The drill recited in claim 17 comprising four said chambers encapsulating a gel material, two of said chambers disposed to protrude from each said gripping region, each of said chambers discreet from each other.

19. A power tool comprising:

a housing having a handle;

a motor to actuate an output member of the power tool; wherein, said handle comprises a gel material and a region of material which is relatively hard as compared to said gel material, said gel material surrounded by a pair of flexible sheets defining a chamber, said gel-containing chamber contains a vibration damping gel material and said pair of sheets are sealed to each other at the periphery of the gel-containing chamber, said region disposed about said gel material and clamping said flexible sheets with said handle, said region fastened with said handle such that said region defines the outer surface of said handle at the location of said region and said gel material protrudes outwardly through an aperture formed in said region, such that none of said vibration damping gel is located, in use, between a bottom surface of said region and the handle.

20. The power tool recited in claim 19, said handle comprising a base, said region comprising a cover piece disposed on said base and retaining said gel material on said base, said aperture formed in said cover piece.

21. The power tool recited in claim 19, said gel material enclosed in a chamber formed between upper and lower layers of flexible film.

* * * * *